US006667463B2

(12) United States Patent
Terada

(10) Patent No.: US 6,667,463 B2
(45) Date of Patent: Dec. 23, 2003

(54) HEATER, GLOW PLUG AND WATER HEATER

(75) Inventor: Naoto Terada, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 10/132,730

(22) Filed: Apr. 26, 2002

(65) Prior Publication Data

US 2002/0190049 A1 Dec. 19, 2002

(30) Foreign Application Priority Data

Apr. 27, 2001 (JP) ..... P.2001-131655

(51) Int. Cl.[7] ..... F23Q 7/22
(52) U.S. Cl. ..... 219/270; 123/145 A
(58) Field of Search ..... 219/270, 541; 123/145 A; 29/611; 313/141; 338/238

(56) References Cited

U.S. PATENT DOCUMENTS 4,281,451 A * 8/1981 Mann ..... 29/611
4,549,071 A * 10/1985 Hatanaka et al. ..... 219/270
4,639,712 A * 1/1987 Kobayashi et al. ..... 338/238
4,725,711 A * 2/1988 Minegishi et al. ..... 219/270
5,767,485 A * 6/1998 Kamada ..... 219/270
6,040,519 A * 3/2000 Kita et al. ..... 136/230
6,062,185 A * 5/2000 Chiu et al. ..... 123/145 A
6,130,410 A * 10/2000 Kita ..... 219/270
6,236,148 B1 * 5/2001 Nasu et al. ..... 313/141
2002/0162834 A1 * 11/2002 Asano et al. ..... 219/541

FOREIGN PATENT DOCUMENTS

JP 6-18032 1/1994
JP 11-94253 4/1999

* cited by examiner

*Primary Examiner*—Teresa Walberg
*Assistant Examiner*—Leonid Fastovsky
(74) *Attorney, Agent, or Firm*—Morgan, Lewis & Bockius LLP

(57) ABSTRACT

A heater comprising: a metal sheath; a heating element that is connected to the inner surface of the metal sheath at one end thereof; a center pole that is extending from an opening of the metal sheath to an interior of the metal sheath and directly or indirectly connected to the heating element; an insulating material that is packed in the interior of the metal sheath; and an elastic packing, wherein the opening of the metal sheath is closed by sealing of a gap between the metal sheath and the center pole with the elastic packing, and an axial length of a portion of the elastic packing, the portion is between the metal sheath and the center pole, is not smaller than 2.5 mm.

17 Claims, 2 Drawing Sheets

1 ... Glow plug (heater)

3 ... Metal sheath

4 ... Center pole

6 ... Heating coil (heating element)

14 ... Insulating material

15 ... Elastic packing

HEATER, GLOW PLUG AND WATER HEATER

FIELD OF THE INVENTION

The present invention relates to a heater for heating an object to be heated such as gas and liquid, a glow plug for diesel engine and a water heater for heating water.

BACKGROUND OF THE INVENTION

As a heater for use in a diesel engine there is a glow plug. This glow plug comprises a cylindrical metal shell, an metal sheath forming a heat-generating portion, a heating coil as a heating element provided in the metal sheath, a center pole extending from the opening of the metal sheath to the interior of the metal sheath and connected to the heating coil directly or indirectly with a control coil, and an insulating material packed in the interior of the metal sheath. The opening of the metal sheath is closed by an elastic packing provided between the center pole and the metal sheath.

SUMMARY OF THE INVENTION

Defects of the aforementioned glow plug include expansion of the metal sheath caused by the moistening of the insulating material and oil short caused by the permeation of oil into the metal sheath.

The invention has been worked out under these circumstances. The invention provides a heater comprising a metal sheath, a heating element connected to the inner surface of the metal sheath at one end thereof, a center pole extending from the opening of the metal sheath to the interior of the metal sheath and directly or indirectly connected to the heating element and an insulating material packed in the interior of the metal sheath, the opening of the metal sheath being closed by sealing the gap between the metal sheath and the center pole with an elastic packing, wherein the axial length of the elastic packing between the metal sheath and the center pole is predetermined to be not smaller than 2.5 mm.

By predetermining the length of the elastic packing between the metal sheath and the center pole to be not smaller than 2.5 mm, sealing properties passing a pressure cooker test (Electronic Industries Association of Japan Specification IC-121) can be obtained. Further, no oil short occurs even upon a test involving the repetition of a pattern comprising dipping of the specimen in the oil and subsequent electrical energization thereof.

Preferably, the length of the elastic packing between the metal sheath and the center pole is predetermined to be from 3 mm to 6 mm. The increase of the length of the elastic packing between the metal sheath and the center pole makes it difficult for the elastic packing to be inserted into the sealed portion. However, when the length of the elastic packing between the metal sheath and the center pole falls within the above defined range, it rarely raises a problem of deterioration of insertion properties but provides improved sealing properties giving great advantages.

The aforementioned heater preferably an engagement portion and a metal shell for interference-fitting the metal sheath at the engagement portion. The metal sheath preferably has a fixed (interfitted) portion fixed to the metal shell and a small diameter portion having a smaller diameter than the inner diameter of the engagement portion provided between the fixed portion and the opening. The axial length of the small diameter portion is preferably greater than the length of the elastic packing between the metal sheath and the center pole. In this arrangement, the elastic packing is provided at the small diameter portion. In other words, since the interior of the fixed portion in the metal sheath has no elastic packing provided therein and is filled with an insulating material harder than the elastic packing, it is further assured that the metal sheath can be interference-fitted onto the metal shell.

Further, the difference in diameter between the small diameter portion of the metal sheath and the inner diameter of the fixed portion of the metal shell is preferably from 0.02 mm to 0.5 mm. When the difference in diameter falls below 0.02 mm, it is made difficult for the small diameter portion of the metal sheath to be smoothly inserted into the engagement portion of the metal shell when pressed thereinto. On the contrary, when the difference in diameter exceeds 0.5 mm, the load at which the small diameter portion is pressed into the engagement portion is excessive, making it likely that deformation can occur. The range of difference in diameter within which the desired effect can be exerted is more preferably from 0.02. mm to 0.3 mm.

Preferably, the elastic packing doesn't protrude from the opening of the metal sheath 3 and is received in the interior of the metal sheath 3. Further, when the elastic packing 15 protrudes from the opening of the metal sheath 3, the length of protrusion is preferably not greater than 3 mm. This is. because when the length of protrusion of the elastic packing 15 from the opening of the metal sheath 3 falls within a range of from 0 to 3 mm, the protruding elastic packing 15 can be prevented from interfering with the insertion of the metal sheath 3 into the metal shell 2.

The material of the elastic packing is preferably a silicon rubber or fluororesin because it has an excellent heat resistance as described in claim 6. The elastic packing is also preferably in the form of O-ring or ring having a rectangular section as described in claim 7. In this arrangement, the elastic packing can be easily inserted into the metal sheath. Further, the resulting uniform elastic form in the circumferential direction makes it possible to obtain high sealing properties.

Further, the invention provides a glow plug having the aforementioned heater the purpose of which is predetermined for use in diesel engine as described in claim 8. Moreover, the invention provides a water heater having the aforementioned heater the purpose of which is predetermined to heat water as described in claim 9.

DESCRIPTION OF THE REFERENCE NUMERALS AND SIGNS

Figure 1:
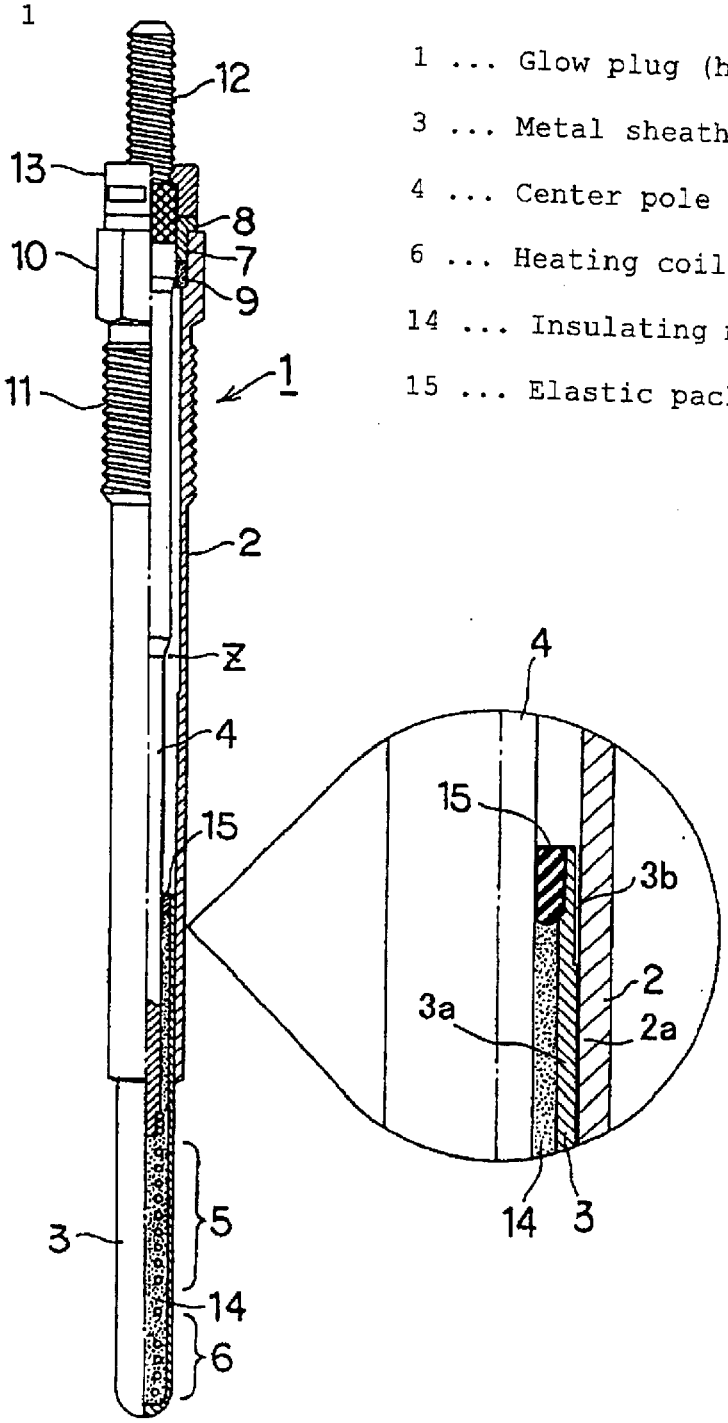
FIG. 1 is a front view with its right half shown in section.

1 . . . Glow plug (heater)
2 . . . Metal shell
2a . . . Engagement portion
3 . . . Metal sheath
3a . . . Fixed portion
3b . . . Small diameter portion
4 . . . Center pole
6 . . . Heating coil (heating element)
14 . . . Insulating material
15 . . . Elastic packing

DETAILED DESCRIPTION OF THE INVENTION

Figure 2A:
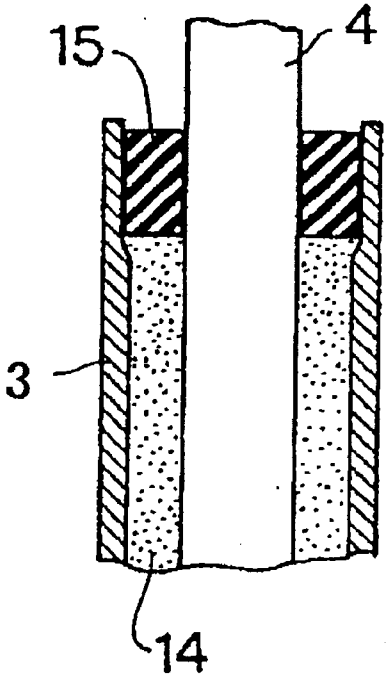
FIGS. 2(*a*), 2(*b*) and 2(*c*) are a sectional view of essential part illustrating the step of mounting the elastic packing.
Figure 2B:
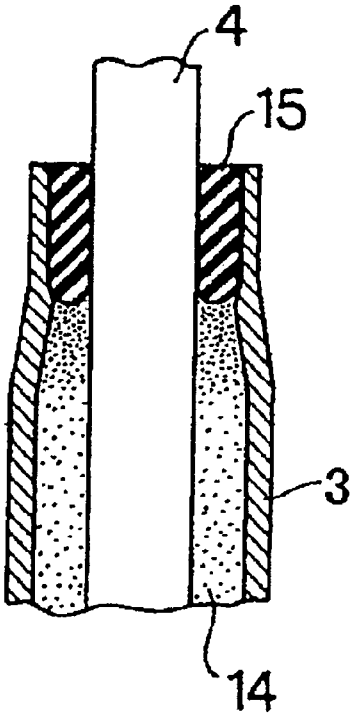
Figure 2C:
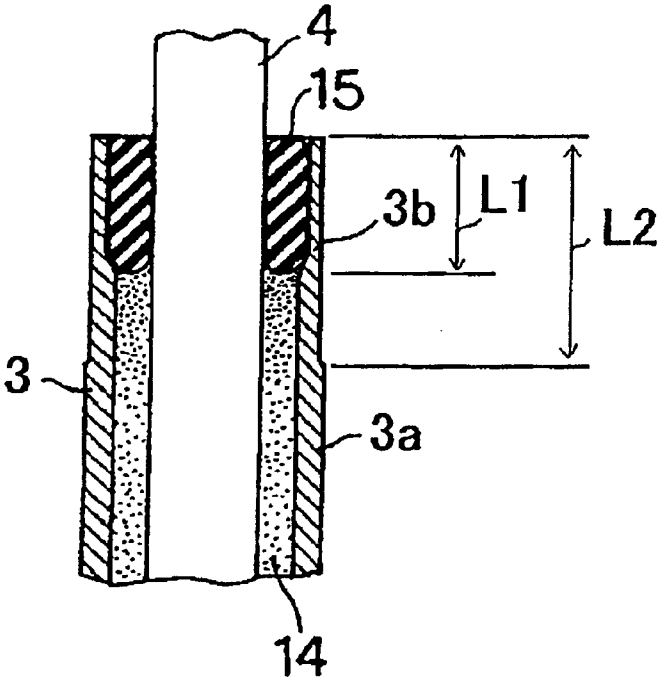

Embodiments of implementation of the invention will be described hereinafter with reference to glow plug. FIG. 1 is a front view with its right half shown in section. FIGS. 2(*a*) to (*c*) each are a sectional view of essential part showing the step of mounting the elastic packing.

A glow plug 1 generally comprises a cylindrical metal shell 2, a metal sheath 3 fixed to the forward end of the metal shell 2 and a center pole 4 as an electrode as shown in FIG. 1. The center pole 4 extends through the center of the metal shell 2 to the interior of the metal sheath 3. Further, the bottom of the metal sheath 3 and the forward end of the center pole 4 are electrically connected to each other with a control coil 5 and a heating coil 6 as a heating element. While in the present embodiment the control coil 5 is provided interposed between the center pole 4 and the heating coil 6 to connect the two parts indirectly to each other, the heating coil 6 and the center pole 4 maybe directly connected to each other without providing any control coil 5.

Further, the metal sheath 3 is interference-fitted (engaged) onto the engagement portion 2*a* of the metal shell 2 at the fixed portion 3*a*.

The metal shell 2 has a stepped hole 7 formed at the upper end thereof. A bushing-shaped insulating ring 8 fitted in the stepped hole 7 supports the upper part of the center pole 4 at the center of the metal shell 2 and causes the two parts to be electrically insulated from each other. There is formed a gap between the stepped hole 7 and the center pole 7. The gap is filled with an O-ring 9.

On the other hand, the metal shell 2 has a hexagon bolt-shaped tool engagement portion 10 provided on the periphery of the upper body portion thereof and a male thread formed below the tool engagement portion 10 for mounting on a diesel engine (not shown) The center pole 4 has a thread portion 12 formed on the top thereof for connecting to a power cable (not shown). A round nut 13 engaged with the thread portion 12 holds the insulating ring 8.

The metal sheath 3 is formed by an electrically-conductive metal. The interior of the metal sheath 3 is filled with an insulating material 14 such as magnesia powder. The gap between the metal sheath 3 and the center pole 4 is sealed with an elastic packing 15. The elastic packing 15 blocks the opening of the metal sheath 3. FIGS. 2(*a*) to (*c*) indicate the sealing step.

The elastic packing 15 is a ring having a rectangular section made of silicone rubber or fluororesin (fluororubber). The height and thickness of the elastic packing 15 are predetermined such that the length thereof between the metal sheath and the center pole is not smaller than 2.5 mm in expectation of deformation (collapse) at the sealing step. Further, the metal sheath 3 has the heating coil 6 connected to the bottom thereof at the previous step. The center pole 4 protrudes from the open end of the metal sheath 3. However, the center pole 4 consists of two parts which are jointed at a portion shown by the symbol Z in FIG. 1. The two parts of the center pole 4 are welded to each other after the termination of the step of sealing the metal sheath 3. Accordingly, the center pole 4 is in the form of semi-finished product, i.e., mere round rod until the termination of the sealing step.

Thus, the insulating material 14 is put in the interior of the metal sheath 3 leaving a space for inserting the elastic packing 15. Subsequently, the insulating material 14 attached to the inner surface of the metal sheath 3 is completely removed. The metal sheath 3 has a reduced thickness on the inner side thereof corresponding to the elastic packing 15.

Subsequently, the elastic packing 15 is inserted into the semi-finished product over the center pole 4. The elastic packing 15 is then inserted into the space of the metal sheath 3 as shown in FIG. 2(*a*). Subsequently, as shown in FIG. 2(*b*), the metal sheath 3 is swaged only at the upper portion thereof to squeeze the elastic packing 15. Subsequently, as shown in FIG. 2(*c*), the metal sheath 3 is entirely swaged to a predetermined size. Thus, at the time when the sealing step is completed, the axial length L1 of the elastic packing 15 between the metal sheath and the center pole is not smaller than 2.5 mm, preferably from 3 mm to 6 mm.

Further, it is preferred that the elastic packing 15 do not protrude from the opening of the metal sheath 3 as shown in FIG. 2(*c*). In the case where the elastic packing 15 protrudes from the opening of the metal sheath 3, the length of protrusion is preferably not greater than 3 mm. This is because when the length of protrusion of the elastic packing 15 from the opening of the metal sheath 3 falls within a range of from 0 to 3 mm, the protruding elastic packing 15 can be prevented from interfering with the insertion of the metal sheath 3 into the metal shell 2.

The metal sheath 3 has a small diameter portion 3*b* formed in the vicinity of the opening thereof. The outer diameter of the small diameter portion 3*b* is predetermined to be smaller than that of the fixed portion 3*a*. Since the outer diameter of the small diameter portion 3*b* is predetermined to be smaller than the inner diameter of the engagement portion 2*a* of the metal shell 2 by 0.02 mm to 0.5 mm, the load applied to the metal sheath 3 when the metal sheath 3 is pressed into the engagement portion 2*a* can be minimized, making it possible to smoothly insert the metal sheath 3 into the engagement portion 2*a* and fix the metal sheath 3 to the engagement portion 2*a*. Further, since the difference between the outer diameter of the metal sheath 3 and the inner diameter of the engagement portion 2*a* of the metal shell 2 is as small as not greater than 0.5 mm, making it possible to secure the outer diameter of the small diameter portion 3*b* at maximum, the strength of the metal sheath 3 can be maximized.

Further, the axial length L2 of the small diameter portion 3*b* is predetermined to be greater than the axial length L1 of the elastic packing 15 between the metal sheath and the center pole, i.e., L2>L1 (in which L2=5 to 25 mm). Accordingly, the metal sheath 3 has no elastic packing 15 provided at the fixed portion 3*a* but has the insulating material 14 packed there in at the fixed portion 3*a*. Accordingly, the fixed portion 3*a* can be made harder, making it possible to keep the metal sheath 3 interference-fitted onto the center pole 4 at the engagement portion 2*a*.

EXAMPLES

Five trial products having different lengths of elastic packing 15 between the metal sheath and the center pole were prepared. These trial products were each subjected to pressure cooker test (Electronic Industries Association of Japan Specification IC-121) as a hygroscopicity test. These trial products were also each subjected to a test involving the repetition of a pattern comprising dipping of the specimen in the oil and subsequent electrical energization thereof to examine the occurrence of oil short. The results of the tests are set forth in Tables 1 and 2. In these tables, the symbol "x" indicates that all the trial products show a problem, the symbol "○" indicates that some of the trial products show a problem, and the symbol "◎" indicates that none of the trial products show a problem.

TABLE 1

| | Length between the metal sheath and the center pole (mm) | Material of elastic packing | |
|---|---|---|---|
| | | Silicone rubber | Fluororesin |
| 1 | 1.5 | x | x |
| 2 | 2.0 | x | ○ |
| 3 | 2.5 | ○ | ◎ |
| 4 | 3.0 | ◎ | ◎ |
| 5 | 3.5 | ◎ | ◎ |

TABLE 2

| | Length between the metal sheath and the center pole (mm) | Material of elastic packing | |
|---|---|---|---|
| | | Silicone rubber | Fluororesin |
| 1 | 1.5 | ○ | ○ |
| 2 | 2.0 | ○ | ○ |
| 3 | 2.5 | ◎ | ◎ |
| 4 | 3.0 | ◎ | ◎ |
| 5 | 3.5 | ◎ | ◎ |

As can be seen in these results, when the length of the elastic packing 15 between the metal sheath and the center pole is not smaller than 2.5 mm, both the elastic packing 15 made of silicone rubber and the elastic packing 15 made of fluororesin can exert an effect of preventing the expansion of the metal sheath 3 due to moistening. In particular, the elastic packing 15 made of fluororesin was observed to exert an effect of preventing the expansion of the metal sheath 3. Further, the elastic packing 15 made of fluororesin and the elastic packing 15 made of silicone rubber were observed to exert a remarkable effect of preventing the occurrence of oil short when the length of the elastic packing in closely contact with the sealed surface is not smaller than 2.5 mm.

While the invention has been described with reference to an embodiment, the invention is of course not limited to the aforementioned embodiment. For example, while the elastic packing 15 of the aforementioned embodiment is in the form of ring having a rectangular section (cylindrical form), it may be in the form of O-ring having a circular section. While the aforementioned embodiment has been described with reference to the glow plug 1, the invention can be used as a water heater (Specific examples of use include household appliances such as kettle, water tank for fish or the like, and antifreezing device for water piping).

In accordance with the invention, the length of the elastic packing between the metal sheath and the center pole is predetermined to be not smaller than 2.5 mm, making it possible to obtain excellent sealing properties passing a pressure cooker test (Electronic Industries Association of Japan Specification IC-121). Further, an excellent effect can be exerted of preventing the occurrence of oil short even upon a test involving the repetition of a pattern comprising dipping of the specimen in the oil and subsequent electrical energization thereof.

Further, the increase of the length of the elastic packing between the metal sheath and the center pole makes it difficult for the elastic packing to be inserted into the sealed portion. However, when the length of the elastic packing between the metal sheath and the center pole is predetermined to be from 3 mm to 6 mm, it rarely raises a problem of deterioration of insertion properties but provides improved sealing properties giving great advantages.

This application is based on Japanese Patent application JP 2001-131655, filed Apr. 27, 2001, the entire content of which is hereby incorporated by reference, the same as if set forth at length.

What is claimed is:

1. A heater comprising:

a metal sheath;

a heating element that is connected to an inner surface of the metal sheath at one end thereof;

a center pole that is extending from an opening of the metal sheath to an interior of the metal sheath and directly or indirectly connected to the heating element;

an insulating material that is packed in the interior of the metal sheath; and an elastic packing, wherein the opening of the metal sheath is closed by sealing a gap between the metal sheath and the center pole with the elastic packing; and an axial length of a portion of the elastic packing, the portion is between the metal sheath and the center pole, and is not smaller than 2.5 mm, and a metal shell having an engagement portion, wherein the metal shell interfits the metal sheath by the engagement portion, the metal sheath has a fixed portion fixed to the metal shell and a small diameter portion having a smaller diameter than an inner diameter of the engagement portion, the small diameter portion being between the fixed portion and the opening, and an axial length of the small diameter portion is greater than the axial length of the portion of the elastic packing.

2. The heater according to claim 1, wherein the axial length of the portion of the elastic packing is from 3 mm to 6 mm.

3. A heater comprising:

a metal sheet;

a heating element that is connected to the inner surface of the metal sheath at one end thereof;

a center pole that is extending from an opening of the metal sheath to an interior of the metal sheath and directly or indirectly connected to the heating element;

an insulating material that is packed in the interior of the metal sheath; and an elastic packing, wherein the opening of the metal sheath is closed by sealing of a gap between the metal sheath and the center pole with the elastic packing, and an axial length of a portion of the elastic packing, the portion is between the metal sheath and the center pole, is not smaller than 2.5 mm, and wherein a difference in diameter between the small diameter portion of the metal sheath and an inner diameter of the fixed portion of the metal shell is from 0.02 and 0.5 mm.

4. The heater according to claim 1, wherein the elastic packing has the portion that is between the metal sheath and the center pole, and optionally has a protruding-portion that is not between the metal sheath and the center pole wherein an axial length of the protruding-portion is 0 mm to 3 mm.

5. A heater comprising:

a metal sheet;

a heating element that is connected to the inner surface of the metal sheath at one end thereof;

a center pole that is extending from an opening of the metal sheath to au interior of the metal sheath and directly or indirectly connected to the heating element;

an insulating material that is packed in the interior of the metal sheath; and an elastic packing, wherein the opening of the metal sheath is closed by sealing of a gap between the metal sheath and the center pole with the elastic packing, and an axial length of a portion of the elastic packing, the portion is between the metal sheath and the center pole, is not smaller than 2.5 mm, and wherein the elastic packing comprises a fluororesin.

6. The heater according to claim 1, wherein the elastic packing is prepared by using a ring having a rectangular section.

7. A glow plug which is a heater according to claim 1, adapted to be mounted on a diesel engine.

8. A water heater which is a heater according to claim 1, adapted to be used for heating water.

9. The heater according to claim 3, wherein the axial length of the portion of the elastic packing is from 3 mm to 6 mm.

10. The heater according to claim 3, wherein the elastic packing has the portion that is between the metal sheath and the center pole, and optionally has a protruding-portion that is not between the metal sheath and the center pole wherein an axial length of the protruding-portion is 0 mm to 3 mm.

11. The heater according to claim 3, wherein the elastic packing is prepared by using a ring having a rectangular section.

12. A glow plug which is a heater according to claim 3, adapted to be mounted on a diesel engine.

13. A water heater which is a heater according to claim 3, adapted to be used for heating water.

14. The heater according to claim 5, wherein the elastic packing has the portion that is between the metal sheath and the center pole, and optionally has a protruding portion that is not between the metal sheath and the center pole wherein an axial length of the protruding-portion is 0 mm to 3 mm.

15. The heater according to claim 5, wherein the elastic packing is prepared by using a ring having a rectangular section.

16. A glow plug which is a heater according to claim 5, adapted to be mounted on a diesel engine.

17. A water heater which is a heater according to claim 5, adapted to be used for heating water.

* * * * *